US005568243A

United States Patent [19]

Durfee et al.

[11] Patent Number: 5,568,243

[45] Date of Patent: Oct. 22, 1996

[54] CLEANING MECHANISM FOR A TRANSFER DRUM OF A REPRODUCTION APPARATUS

[75] Inventors: Katherine E. Durfee, Rochester; James C. Barry, Fairport; Charles J. Bennett, Hilton; Gary B. Bertram, Honeoye Falls; Mark Kristansen, Churchville; Bruce D. MacLellan, Ontario; Anthony Sacino, Rochestor, all of N.Y.

[73] Assignee: Eastman Kodak Company, Rochester, N.Y.

[21] Appl. No.: 270,062

[22] Filed: Jul. 1, 1994

[51] Int. Cl.[6] ..... G03G 21/00

[52] U.S. Cl. ..... 355/299; 15/256.51; 355/297; 355/302

[58] Field of Search ..... 355/271, 274, 355/296, 299, 297, 302; 15/256.51, 256.52, 256.5

[56] References Cited

U.S. PATENT DOCUMENTS

| | | | |
|---|---|---|---|
| 3,819,263 | 6/1974 | Draugelis et al. . | |
| 4,181,425 | 1/1980 | Higaya et al. | 15/256.52 X |
| 4,253,761 | 3/1981 | Takizawa et al. | 355/296 |
| 4,382,673 | 5/1983 | Nakajima et al. | 355/271 |
| 4,588,279 | 5/1986 | Fukuchi et al. | 355/271 |
| 4,640,608 | 2/1987 | Higaya et al. | 355/15 |
| 4,712,902 | 12/1987 | Hosomizu et al. | 354/416 |
| 4,862,224 | 8/1989 | Ku | 355/200 |
| 4,906,335 | 3/1990 | Goodnow et al. | 162/281 |
| 4,958,194 | 9/1990 | Kaieda et al. | 355/277 |
| 4,998,143 | 3/1991 | Kumasaka et al. | 355/271 |
| 5,084,739 | 1/1992 | Kalyandurg et al. | 355/299 |
| 5,101,238 | 3/1992 | Creveling et al. | 355/271 |
| 5,148,227 | 9/1992 | Senba et al. | 355/296 |
| 5,168,313 | 12/1992 | Hosaka et al. | 355/274 |
| 5,233,394 | 8/1993 | Fujita et al. | 355/271 |
| 5,279,710 | 1/1994 | Aikawa | 162/281 |
| 5,284,516 | 2/1994 | Sieberth | 118/123 |
| 5,335,052 | 8/1994 | Sato et al. | 355/271 |
| 5,408,720 | 4/1995 | Miles | 15/256.5 |

*Primary Examiner*—Thu Anh Dang

*Attorney, Agent, or Firm*—Nelson Adrian Blish; Lawrence P. Kessler

[57] ABSTRACT

A reproduction apparatus including a transfer drum for electrostatic transfer of a toner image from an image bearing member, and a transfer drum cleaning mechanism. The transfer drum cleaning mechanism comprises a member for wiping the surface of the transfer drum to remove residual toner and debris therefrom. The wiper is selectively movable into operative relation with the transfer drum surface. A blade member is provided for removing toner and debris from the wiper. The blade member is resiliently urged into association with the wiper under substantially uniform load.

8 Claims, 4 Drawing Sheets

CLEANING MECHANISM FOR A TRANSFER DRUM OF A REPRODUCTION APPARATUS

BACKGROUND OF THE INVENTION

1. Field of the Invention

This invention relates, in general, to electrostatic transfer in a reproduction apparatus, and more specifically, to a device for cleaning a transfer drum of such apparatus.

2. Description of the Prior Art

Cleaning devices for transfer drums in reproduction apparatus, such as electrographic copiers or printers, are well known. For example, color copiers presently available attach a sheet of paper to a transfer drum. The drum is rotated a plurality of times bringing a transfer surface of the sheet into transfer relationship with an electrophotographic imaging member. With each presentation of the transfer surface to the imaging member a different colored toner image is transferred to the transfer surface, generally under the urging of an electric field. Several color images are superposed in this manner forming a multicolor image on the transfer surface.

Inevitably, toner and paper fibers get on the external cylindrical surface of the transfer drum cleaning roller itself where they then transfer to the rear of the next cleaning sheet. Fur brush cleaners and web cleaners have been used commercially to clean the external cylindrical surface of transfer drums in such apparatus; see, for example, U.S. Pat. No. 3,819,263. Such cleaning devices are articulated from a position out of contact with the drum, when the apparatus is in a transfer mode, to a position in cleaning engagement with the drums, when the apparatus is in a cleaning mode. Fur brushes generally require vacuum or other fairly complex mechanism to get rid of the toner and also must be driven by a motor. Web cleaners are less expensive but the web itself must be indexed and the web must be changed periodically.

Transfer drums are also known which receive toner images directly to their external cylindrical surface without the interposition of a transfer sheet. In color apparatus, these drums receive more than one image in registration to their surface forming a multicolor image on the drum surface. The multicolor image is transferred to a transfer sheet either in the same nip as the original toner images were transferred or at a location remote from the original nip. Because of incomplete transfer to the transfer sheet, the external cylindrical surface of these drums generally must be cleaned between formation of each multicolor image.

Roller cleaners have been used commercially to clean reproduction apparatus transfer drums; see for example, U.S. Pat. No. 4,862,224 (issued Aug. 29, 1989, in the name of Ku). In its simplest form, a soft conductive rubber roller is allowed to roll with the transfer drum, an electrical bias is applied to such rubber roller to attract the toner to it from the transfer drum, and the softness of the rubber roller compared to the surface of the transfer drum cooperates with that bias to clean the drum. The roller itself passes into contact with a scraper blade which scrapes the toner into a disposing mechanism, for example, a housing or the like.

A problem which must be overcome in scraping toner from the cleaning roller of a device of the above type is that it is difficult to maintain the scraper blade in proper intimate association with the transfer drum. That is, the scraper blade can become loose in its holder, or can assume a wave-form shape due to uneven clamping forces in the holder. As such, the scraper blade is not maintained in uniform contact with the transfer drum. This results in incomplete cleaning of toner and other debris from the transfer roller. To rectify incomplete cleaning, it has been necessary in the past to change the scraper blade. However, due to the construction of the roller cleaner, replacement of the scraper blade has been difficult.

SUMMARY OF THE INVENTION

It is an object of this invention to provide reproduction apparatus generally of the type having a cleaning device which is articulated into cleaning relation with an external surface of a transfer drum when said apparatus is in a cleaning mode and out of such cleaning relation when in a transfer mode, which cleaning device solves the latter mentioned scraper blade problem and is simple in construction and economical to manufacture.

This and other objects are accomplished by providing a reproduction apparatus including a transfer drum for electrostatic transfer of a toner image from an image bearing member, and a transfer drum cleaning mechanism. The transfer drum cleaning mechanism comprises a member for wiping the surface of the transfer drum to remove residual toner and debris therefrom. The wiper, for example an electrically biased soft rubber roller, is selectively movable into operative relation with the transfer drum surface. A blade member is provided for removing toner and debris from the wiper. The blade member is resiliently urged into association with the wiper under substantially uniform load.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENT

Figure 1:
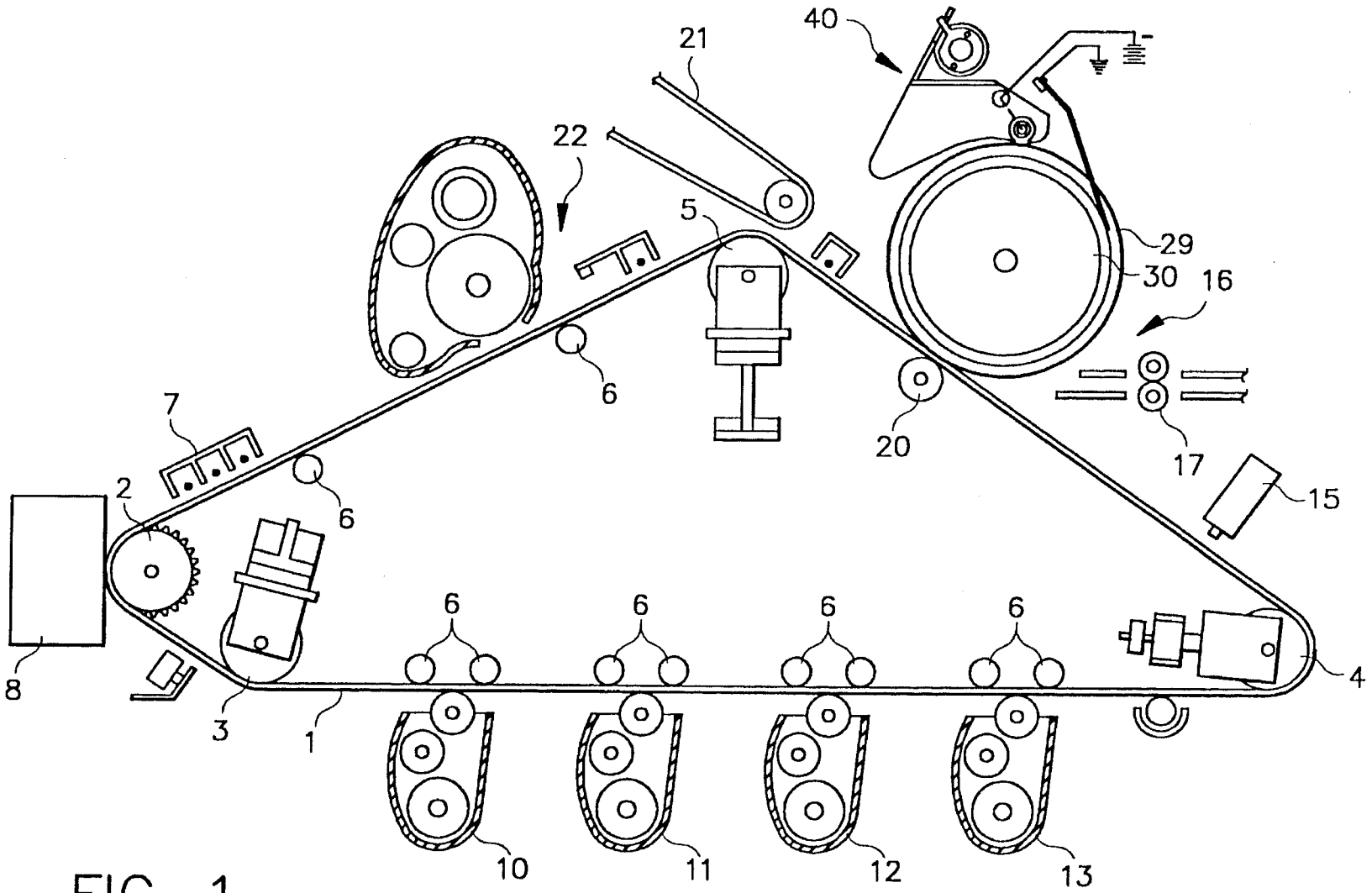
FIG. 1 is a schematic side elevational view of a reproduction apparatus incorporating a cleaning mechanism for a transfer drum according to this invention.

According to FIG. 1, an exemplary reproduction apparatus of the type described in aforementioned U.S. Pat. No. 4,862,224 is shown. Such reproduction apparatus is described herein to the extent necessary for a complete understanding of this invention. The reproduction apparatus includes an imaging member, for example, an electrophotosensitive endless web 1 mounted on a series of rollers 2, 3, 4 and 5 and partially supported by film skis 6. According to conventional technology, imaging member 1 is transported about the endless path in the direction of arrow A where it is uniformly charged at a charging station 7, exposed at an electronic exposure station 8 to create an electrostatic image, and developed at one of toning stations 10, 11, 12 and 13 to form a toner image electrostatically held on the web. The toner image is transferred at a transfer station 16 to a transfer surface. Residual toner is cleaned from the web 1 at a cleaning station 22 and the imaging member 1 is reused.

The exemplary reproduction apparatus shown in FIG. 1 is adapted to make multicolor reproductions. As is well known in the art, these multicolor reproductions are made by superimposing consecutive differently colored images carried by image member 1 on the transfer surface at transfer station 16. More specifically, consecutive cyan, magenta, yellow and black images are formed on imaging member 1 corresponding to different components of a proposed multicolored image. In one embodiment, as the images approach the transfer station 16, a receiver sheet is fed by sheet handling apparatus 17 into engagement with an external cylindrical surface 29 of a transfer drum 30. The receiver sheet is held to the drum by suitable means, for example, small gripping fingers or vacuum vents, not shown, see for example, U.S. Pat. No. 4,712,902, Bothnet et al. As transfer drum 30 is rotated in a clockwise direction, it brings the transfer surface of the receiver sheet into transfer relation two, three or four separate times with imaging member 1, forming a two, three or four color image on the transfer surface. The receiver sheet is separated from the external cylindrical surface 29 by elimination of the gripping mechanism, for example, by reduction in the vacuum holding force, or by a more positive stripping mechanism, not shown. The receiver sheet then continues with the imaging member to a separation position associated with roller 5 where it is picked up by a transport mechanism 21 and transported to a fuser and an output tray, not shown, and all is well-known in the art.

Alternatively the 4-color toner images can be transferred in registration directly to the external cylindrical surface 39 of transfer drum 30 and then the resulting multicolor image transferred to a surface of a receiver sheet. In such embodiment the receiver sheet can still be fed by sheet handling mechanism 17 into the transfer nip after the multicolor image is formed on the external cylindrical surface 29. The transfer to the receiver sheet can also be performed at a position on the external cylindrical surface 29 that is remote from the original transfer site.

In both of these embodiments, transfer is effected, as is well known in the art, in the presence of an electric field which urges the toner from the imaging member to the transfer surface. For example, using an imaging member 1 having a conductive backing that is grounded, initial electrostatic charge is placed on that member at the charging station 7 of positive 700 volts. After discharge by exposing station 8 to a minimal voltage of say positive 100 volts, the discharged areas are toned by the application of toner carrying a positive charge, which toner adheres to the exposed, discharged portions. At the transfer station a bias of a negative potential, for example negative 2,000 volts, is placed on the drum 30 relative to a grounded conductive backing on imaging member 1. Alternatively, the potential of the imaging member 1 can be controlled by applying a ground bias to a back-up roller 20.

In both embodiments discussed above, the external cylindrical surface 29 of the transfer drum 30 picks up substantial amounts of toner and also other debris such as dust and paper fiber. In the embodiment in which the toner images are transferred directly to the external cylindrical surface 29 residual toner must be cleaned off after transfer of each multicolor image. In the embodiment in which toner is transferred directly to the transfer surface of a receiver sheet to form the multicolor image directly on the receiver sheet, the external cylindrical surface 29 must be cleaned from time to time. Obviously, the cleaning mechanism cannot engage the external cylindrical surface while images are being transferred. Accordingly, cleaning mechanisms constructed according to prior art have been mounted for pivotal, articulating movement in and out of engagement with the external cylindrical surface 29. Such structures in the prior art have been complex and expensive. In some instances, they wear the surface of the transfer drum.

Additionally, such cleaning devices have faced the problem of removing toner held to a surface to which that toner is attracted by a relatively high potential, as in the example given above, negative 2,000 volts with respect to the imaging member.

As fully described in aforementioned U.S. Pat. No. 4,862,224, a cleaning mechanism 40 is provided which includes a housing 41 shaped to provide a chamber 42 to collect toner (see FIGS. 2 and 3). The housing is preferably molded in one piece out of a suitable plastic. The housing contains an elongated portion 42 supporting end walls 44 and 45 (see FIG. 4). Chamber 42 is closed by a cover 50. A cleaning roller 51 is journaled for rotation in mounts in openings in end walls 44 and 45. Roller 51 should be made of a conductive material which is softer than the cylindrical surface 29 to be cleaned. For example, it can be made of a conductive silicone rubber having a surface resistivity of $10^4$ ohm-cm and a softness of 30 shore A, when cleaning an external cylindrical surface of polyurethane having a surface conductivity of $10^{11}$ ohm-cm and a softness of 55 shore A. Such rollers inflict negligible damage to the transfer drum surface.

The cleaning mechanism is coupled to the reproduction apparatus. Articulation of the mechanism is accomplished by a rotary solenoid 70 mounted as a permanent part of the electrostatic reproduction apparatus. Rotary solenoid 70 engages the edges of a recess 71 in an integral extension 72 of housing 41. When rotary solenoid 70 is actuated in a clockwise direction (FIG. 2), housing 41 is rotated in a clockwise direction bringing cleaning roller 51 into engagement with external cylindrical surface 29. Roller 51 is not separately driven but rolls on the surface of cylindrical surface 29 to clean toner therefrom. Toner cleaned off the surface of roller 29 is scraped from the surface of roller 51 by a scraper blade 55, and toner so scraped falls into chamber 42 where it collects. When rotary solenoid 70 is rotated in a counterclockwise direction the opposite edge of recess 71 is engaged and the housing 41 is rotated about protrusions 60 and 61 in a counterclockwise direction to remove roller 51 from engagement with external cylindrical surface 29, thereby permitting the imaging apparatus to operate in its transfer mode.

Figure 2:
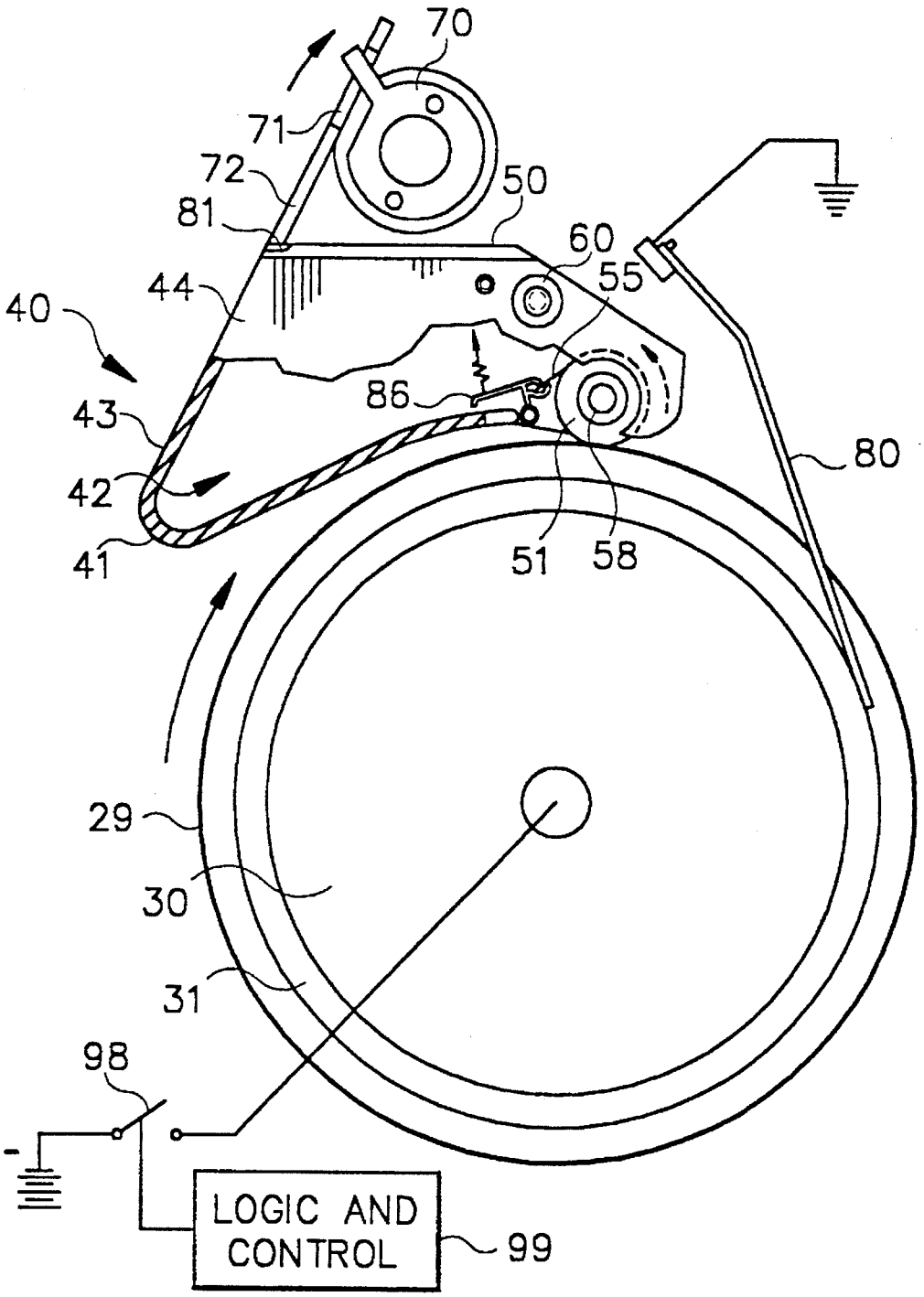
FIGS. 2 and 3 are schematic side elevational views, partly in cross-sections of the cleaning mechanism according to the invention, with portions removed for clarity, showing the mechanism in its two operating positions, respectively.
Figure 3:
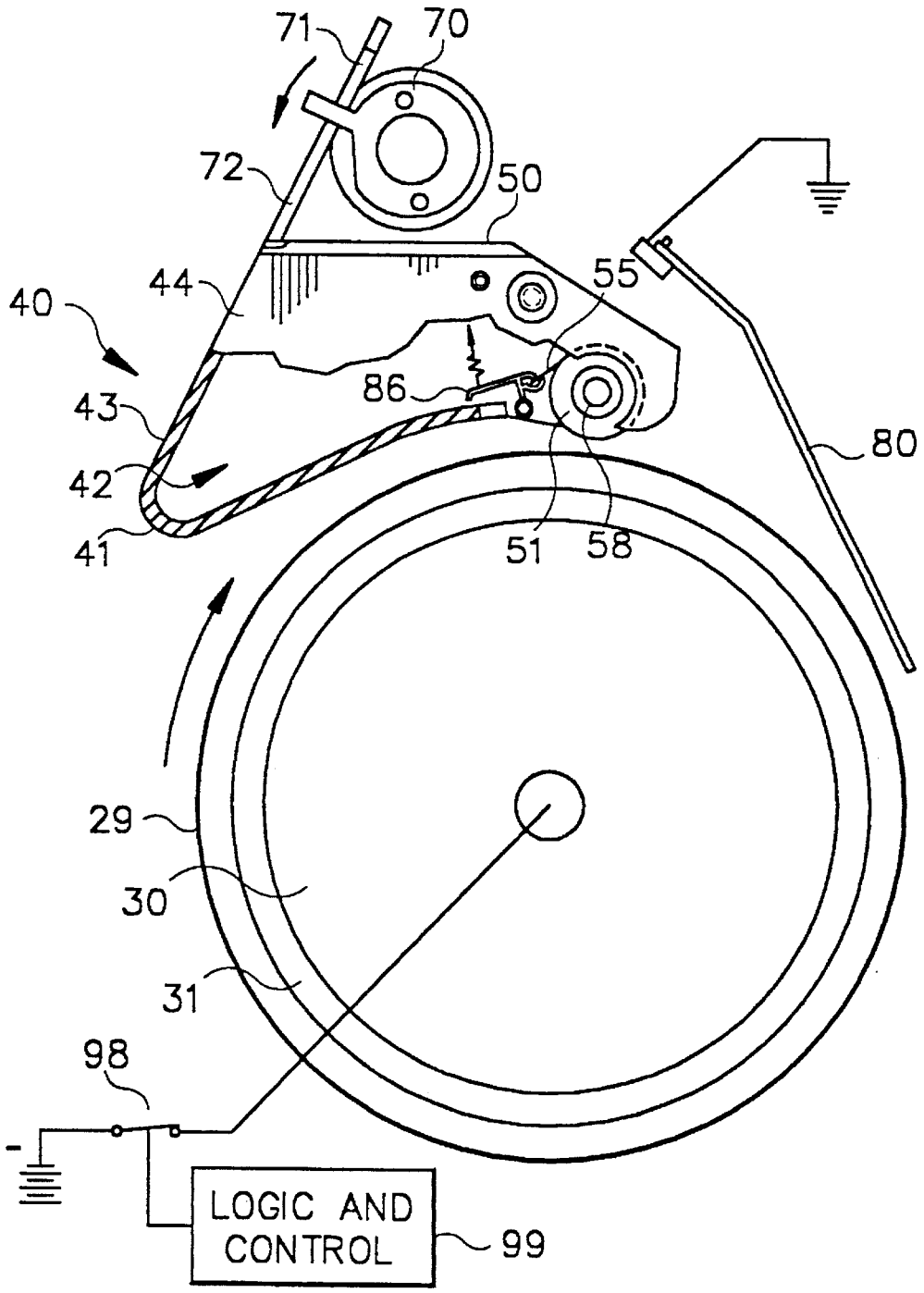
Figure 4:
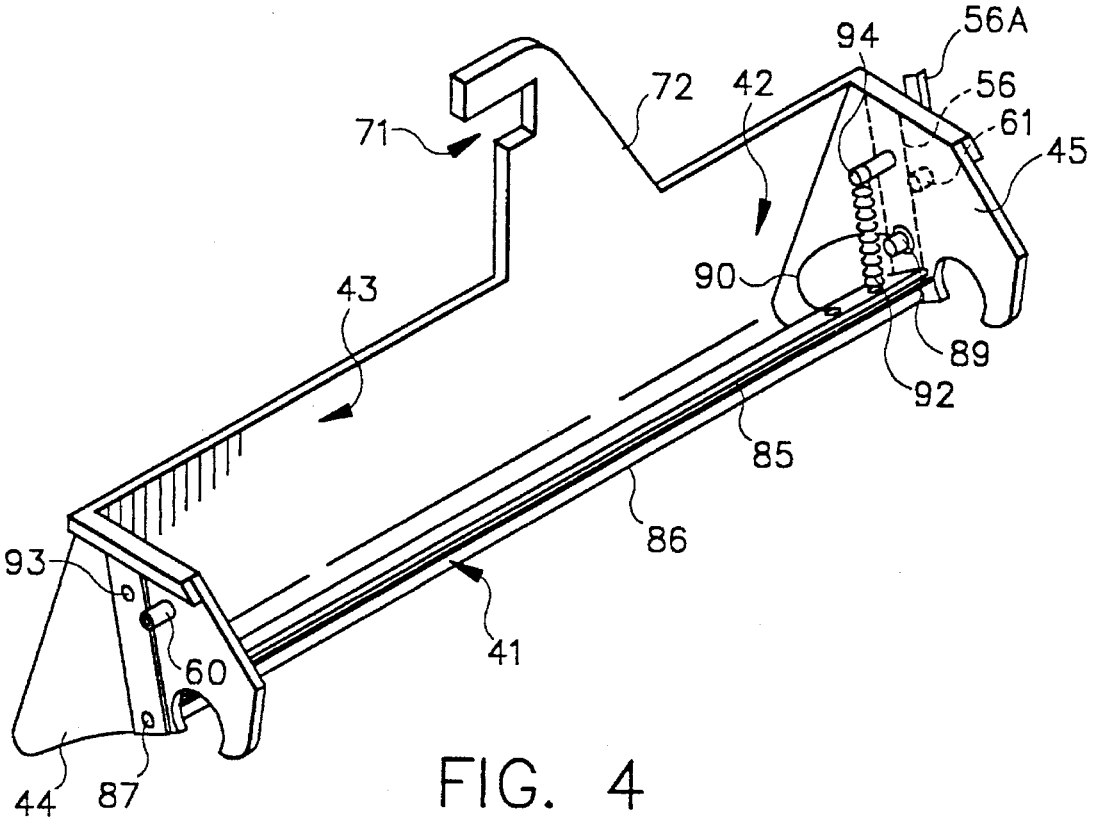
FIG. 4 is a view in perspective, of a portion of the housing of the cleaning mechanism and scraper blade holder shown in FIG. 2.
Figure 5:
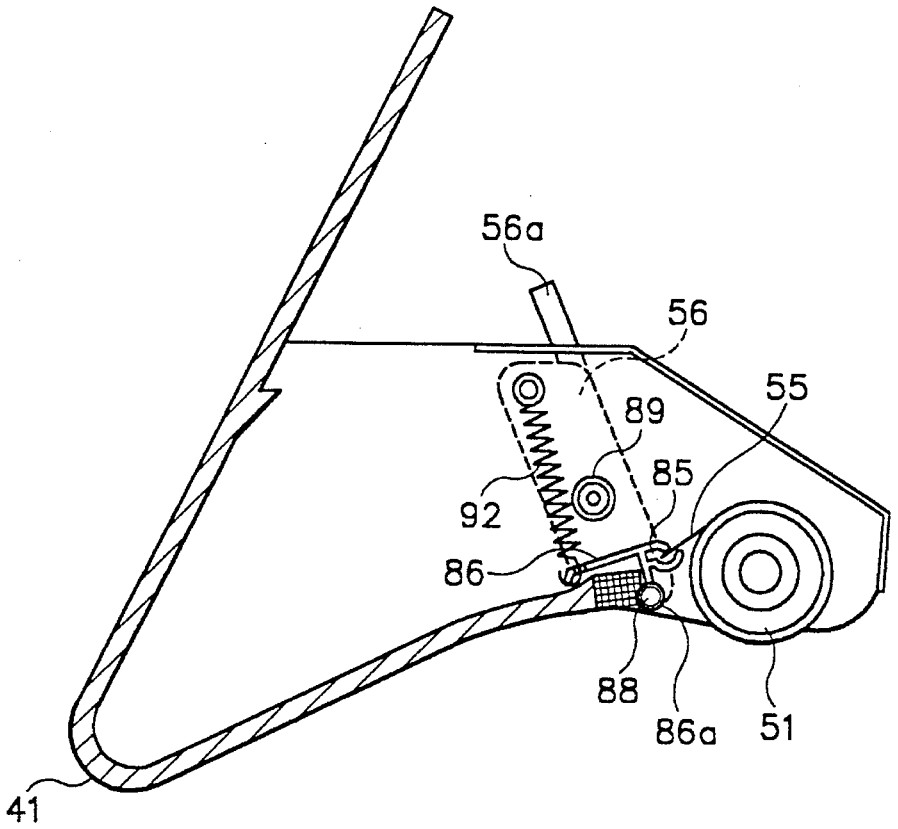
FIG. 5 is a schematic side elevational view, in cross-section, of a portion of the cleaning mechanism and holder for retaining the scraper blade.

As shown in FIGS. 2, 3, and 5, according to this invention, scraper blade 55 is positioned in an elongated slot 85 in blade holder 86. The blade holder 86 is a substantially rigid elongated electrically conductive member formed, for example, by an extrusion process. The blade holder includes a distending portion defining a channel **86*a*, which is mounted on pivot pins 87 and 88 provided respectively in the side walls 44 and 45 of housing 41 defining a pivot axis for the blade holder 86, such pivot axis being parallel to the longitudinal axis of the slot 85. Resilient members, such as for example helical extension springs 91 and 92, are connected between support posts 93 and 94 respectively and outboard ends of the blade holder (see FIGS. 4 and 5). The resilient members are selected so as to provide a uniform force urging the blade holder 86 (in a clockwise direction in FIG. 5) about the pivot axis provided by pins 87 and 88**.

With the scraper blade 55 properly located in the elongated slot 85, the free end of the scraper blade is urged by the resilient members into precise working contact with the peripheral surface of the cleaning roller 51 under substantially uniform load.

The elongated slot 85 of the transfer roller cleaning mechanism blade holder 86 has a curved profile (in cross-section best shown in FIG. 5) with sufficient space between the side walls thereof to readily receive a scraper blade 55 therein. In this manner, the scraper blade 55 is easily assembled with the holder 86 and can readily be replaced if necessary. Specifically, when the scraper blade 55 is completely seated along its length at the base of the elongated slot 85, the blade is properly located relative to the blade holder 86, and thus the cleaning roller 51. The curvature of the slot 85, and the load on the scraper blade under the urging of springs 91 and 92 by contact with the roller 51, provide two lines of contact which accurately positively retain the blade within the slot, under a uniform clamping load, with a minimum of constraining forces on the blade. By such retention mechanism, the scraper blade is held in a manner which prevents the above described failure modes (where the blade becomes of a wave-form shape), and maintains the blade in the proper scraping association with the roller 51 over the life of the blade. When the scraper blade does finally wear out, it is easily replaced without necessitating the disassembly of the transfer roller cleaning mechanism and without the use of tools. Specifically, the holder 86 is urged in a direction opposite to the urging direction caused by the springs 91 and 92. This relieves the clamping load on the scraper blade 55, and enables the blade to be readily removed and replaced.

In operation of the transfer roller cleaning mechanism, to attract toner to cleaning roller 51, an electrical bias (for example, of negative 2,000 volts) is applied to roller 51 through electrical connector 56 having an extension piece **56*a* connected in turn to an electrical lead (not shown). Connector 56 is a thin metallic plate (shown in FIGS. 2, 4, and 5) secured to the side wall 45 of the housing 41 by a conductive mounting screw 89. A conductor wire 90 is connected to the mounting screw and to the blade holder 86 to provide an electrically conductive flow path (electrical coupling) therebetween. Accordingly, the voltage bias is thus applied from the reproduction apparatus electrical lead through connector 56, scraper blade holder 86, and scraper blade 55 to the surface of cleaning roller 51**.

When the device is in the cleaning mode, transfer drum 30 must be biased to a potential which in combination with the potential on roller 51, provides a field urging toner from external cylindrical surface 29 to the roller 51. To provide that potential on the drum 30 a leaf spring 80 is mounted to a portion of the frame of the imaging apparatus which is grounded. When the cleaning device is in its cleaning mode, spring 80 rides in contact with a metallic core 31 which is exposed at the edge of drum 30 as shown in FIG. 2. When the imaging apparatus is in its transfer mode rotary solenoid 70 has rotated housing 41 to a position moving roller 51 out of engagement with external cylindrical surface 29. At the same time, spring 80 is moved out of contact with metallic core 31 so that the apparatus can operate in the transfer mode.

In the transfer mode, the bias for the transfer drum is applied directly through the mounting structure for the drum, as is well known in the art. A switch 98 shown schematically in FIG. 2 is closed automatically by a logic and control 99 for the apparatus. Alternatively switch 98 could be located in a manner to be also closed in response to rotation of housing 41 much in the same way that spring 80 is removed from contact with the exposed portion of metallic core 31. Switch 98 could also apply the ground to the drum for the cleaning mode but this approach has the disadvantage of requiring multiple potentials for the same power source and an expensive high voltage switch.

The invention has been described in detail with particular reference to a preferred embodiment thereof, but it will be understood that variations and modifications can be effected within the spirit and scope of the invention as described hereinabove and as defined in the appended claims.

What is claimed is:

1. A reproduction apparatus including a transfer drum, having an external surface, for electrostatic transfer of a toner image from an image bearing member, and a transfer drum cleaning mechanism, said transfer drum cleaning mechanism comprising;

means for wiping said external surface of said transfer drum to remove residual toner and debris therefrom;

a blade member for removing toner and debris from said wiping means; and means for resiliently urging said blade member into association with said wiping means under substantially uniform load, said resilient urging means includes a blade holder defining an elongated slot having spaced side walls for receiving said blade member, said elongated slot having a curved configuration, in cross-section, with sufficient space between the side walls thereof to readily receive said blade member and provide two lines of retention contact with said blade member, when urged into association with said wiping means to positively retain said blade member in said slot, and further having an axis extending in the longitudinal direction thereof, means for mounting said blade holder for pivotal movement about a pivot axis parallel to said longitudinal axis of said slot, and spring means connected to said blade holder to urge said blade holder about said pivot axis in a direction to bring said blade member into operative association with said wiping means.

2. The transfer drum cleaning mechanism of claim 1 wherein said blade holder has a first end and a second end, and wherein said spring means includes a pair of extension springs connected to said blade holder adjacent to said first and second ends thereof respectively.

3. The transfer drum cleaning mechanism of claim 1 wherein said blade holder and said blade member are formed of electrically conductive material, and wherein an electrical potential source is connected to said blade holder to provide an electrical bias to said wiping means through said blade holder and said blade member.

4. A mechanism for cleaning the external surface of a reproduction apparatus transfer drum, said cleaning mechanism comprising;

a housing pivotably mounted in said reproduction apparatus for movement to a position in operative association with said external surface of said transfer drum or a position remote therefrom, said housing having an internal cavity adapted to collect cleaned residual toner and other debris;

means for wiping said external surface of the transfer drum to remove residual toner and debris therefrom, said wiping means being supported in said housing so as to be selectively movable therewith into operative relation with said external surface of said transfer drum surface when said housing is in said operative position;

a blade member for removing toner and debris from said wiping means;

a blade holder adapted to receive said blade member, said blade holder being pivotably supported in said housing, said blade holder defines an elongated slot having spaced side walls for removably receiving said blade member, said slot being of a curved configuration, in cross-section, with sufficient space between the side walls thereof to readily receive said blade member and provide two lines of retention contact with said blade member, when urged into association with said wiping means to positively retain said blade member in said slot, and further having an axis extending in the longitudinal direction thereof; and means for resiliently urging said blade holder in a direction to locate said blade member in operative association with said wiping means under substantially uniform load.

5. The transfer drum cleaning mechanism of claim 4 further including means for mounting said blade holder for pivotal movement about a pivot axis parallel to said longitudinal axis of said slot, and wherein said resilient urging means includes spring means connected to said blade holder to urge said blade holder about said pivot axis in a direction to bring said blade member into operative association with said wiping means.

6. The transfer drum cleaning mechanism of claim 5 wherein said blade holder has a first end and a second end, and wherein said spring means includes a pair of extension springs connected to said blade holder adjacent to said first and second ends thereof respectively.

7. The transfer drum cleaning mechanism of claim 5 wherein said blade holder and said blade member are formed of electrically conductive material, and wherein an electrical connector supported on a wall of said housing is connectable to a potential source and to said blade holder, whereby the potential source can be electrically coupled to said blade holder to provide an electrical bias to said wiping means through said blade holder and said blade member.

8. In a reproduction apparatus including a transfer drum, having an external surface, for electrostatic transfer of a toner image from an image bearing member, and a mechanism for cleaning said external surface of said transfer drum, said cleaning mechanism having a housing pivotably mounted in said reproduction apparatus for movement to a position in operative association with said external surface of said transfer drum or a position remote therefrom, said housing having an internal cavity adapted to collect cleaned residual toner and other debris, means for wiping said external surface of said transfer drum to remove residual toner and debris therefrom, said wiping means being supported in said housing so as to be selectively movable therewith into operative relation with said external surface of said transfer drum when said housing is in said operative position, a blade member for removing toner and debris from said wiping means, a blade holder adapted to receive said blade member, said blade holder being pivotably supported in said housing, and means for resiliently urging said blade holder in a direction to locate said blade member in operative association with said wiping means under substantially uniform load, a method of readily replacing said blade member in said blade holder, said method comprising the steps of;

urging said blade holder in a direction opposite to said direction of urging by said resilient urging means to release the load of said blade on said wiping means;

removing said blade member from said blade holder;

placing a new blade member in said blade holder; and releasing the urging of said blade holder in the direction opposite to said direction of urging by said resilient urging means to enable said blade holder to be urged once again by said resilient urging means to locate said new blade member in operative association with said wiping means under substantially uniform load.

* * * * *